United States Patent [19]

Hassler et al.

[11] 4,428,341

[45] Jan. 31, 1984

[54] ELECTRONIC REGULATING DEVICE FOR RPM REGULATION IN AN INTERNAL COMBUSTION ENGINE HAVING SELF-IGNITION

[75] Inventors: Albin Hassler, Schwieberdingen; Fridolin Piwonka, Tamm, both of Fed. Rep. of Germany

[73] Assignee: Robert Bosch GmbH, Stuttgart, Fed. Rep. of Germany

[21] Appl. No.: 484,022

[22] Filed: Apr. 11, 1983

Related U.S. Application Data

[63] Continuation of Ser. No. 274,926, Jun. 18, 1981, abandoned.

[30] Foreign Application Priority Data

Jun. 21, 1980 [DE] Fed. Rep. of Germany ..... 3023350

[51] Int. Cl.[3] ..... F02D 1/04

[52] U.S. Cl. ..... 123/350; 123/339; 123/359

[58] Field of Search ..... 123/350, 339, 352, 357, 123/340, 359, 358

[56] References Cited

U.S. PATENT DOCUMENTS 3,796,197 3/1974 Locher et al. ..... 123/357
3,952,829 4/1976 Gray ..... 123/352
4,279,229 7/1981 Arnold et al. ..... 123/357
4,367,708 1/1983 Nakamura et al. ..... 123/339

*Primary Examiner*—Raymond A. Nelli
*Attorney, Agent, or Firm*—Edwin E. Greigg

[57] ABSTRACT

An electronic regulating device for regulating the rpm of an internal combustion engine having self-ignition in accordance with at least rpm, fuel quantity and accelerator-pedal position is proposed. The device has a PI regulator with feedback, for example, and is characterized in that the regulator itself is controllable in accordance with the respective rpm deviation. This is effected, with a view to the desired stability of operation, even in the presence of very steep characteristic curves, and the control is effected with a limitation of the respective maximum rpm deviation. To this end, one upper and one lower threshold characteristic curve are realized at either side of a static shutoff characteristic curve. These threshold curves are formed in accordance with rpm and accelerator-pedal position, and where there is a discrete regulator structure, in the case of limitation, they determine the voltage over the capacitor of the regulator determining the I component. With a view to the very steep characteristic curves which are desired, a feedback of the regulator output signal is provided, and the feedback component may have a proportional course or may follow a specific function.

11 Claims, 7 Drawing Figures

ELECTRONIC REGULATING DEVICE FOR RPM REGULATION IN AN INTERNAL COMBUSTION ENGINE HAVING SELF-IGNITION

This is a continuation of application Ser. No. 274,926, filed June 18, 1981, now abandoned.

BACKGROUND OF THE INVENTION

Incorporated herewith by reference is U.S. Pat. No. 4,223,654.

The invention is based on an electronic regulating device for rpm regulation in an internal combustion engine having self-ignition in accordance with rpm, fuel quantity, and accelerator-pedal position having a PI (proportional-integral) regulator and a comparison circuit for instantaneous set-point and idling rpm.

Regulating devices of this kind should function as rapidly as possible, and to this end they exhibit very steep characteristic curves. An electronic rpm regulator with PID (proportional-integral-differential) functioning is known; it has a control capacity for the proportionality range from zero up to approximately 10%. This is attained in the known regulator by varying the set-point rpm value, as the input variable of the regulator, in accordance with the actual value of load (resp. injected fuel quantity).

In electronic P-regulators (proportional action controllers) with purely proportional functioning and very steep characteristic curves, the danger of instability has been demonstrated. In view of the safety, reliability and good driveability which are required in internal combustion engines with self-ignition, this instability is highly undesirable.

The proposed regulating device, which controls rpm, in accordance with fuel quantity, accelerator pedal position and rpm, is provided with a PI regulator which is dependent on rpm deviation assuring the requisite stability even in the case of very steep characteristic curves. Now such steep characteristic curves can be achieved in electronic regulators with same or better performance and higher flexibility compared with pure mechanical systems.

OBJECTS AND SUMMARY OF THE INVENTION

Advantageous modifications of and improvements to the electronic regulating device of the present invention can be attained by (a) combining the information contained in the threshold characteristic curves, which can be derived from performance graph generators, and the static shutoff curve; (b) controlling the regulator as a function of engine rpm and/or accelerator-pedal position; (c) selecting a capacitor voltage for the PI regulator to control the energy status of the PI regulator; (d) using a feedback signal from a regulator as a proportional signal or as an input to a comparator which is then fed to the regulator. It proves to be particularly advantageous that threshold characteristic curves, which are adjacent to the respective static shutoff characteristic curves, can be made available relatively simply.

An object of the present invention is to provide a regulating device which controls fuel quantity flowing to an internal combustion engine in response to rpm, accelerator-pedal position and engine idle rpm.

A further object is to control operation of the regulating device according to engine rpm deviation.

Another object of the invention is to control operation of the regulating device when predetermined thresholds are exceeded by engine rpm or fuel quantity.

An additional object is to control the regulating device in response to information stored in performance graph generators.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
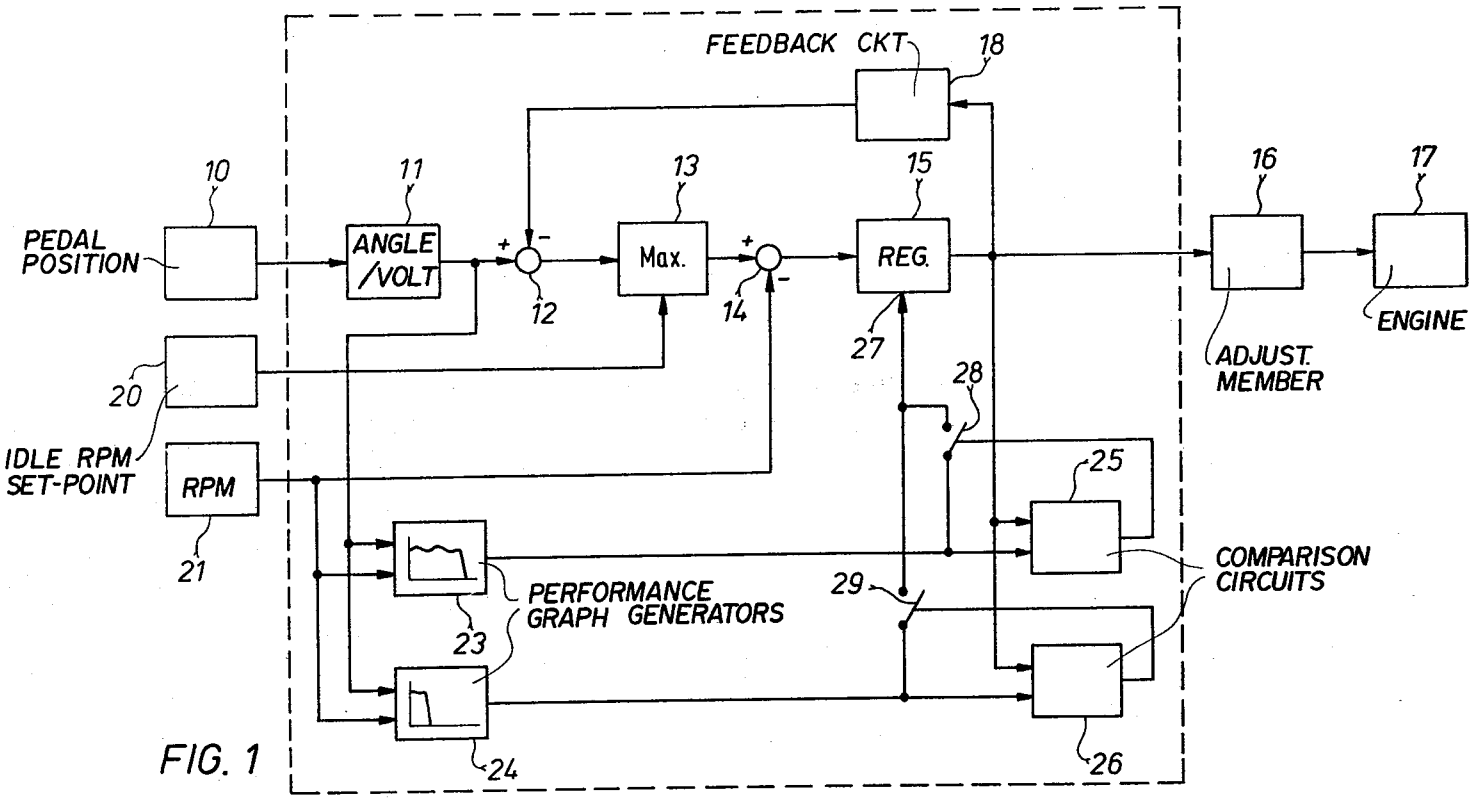
FIG. 1 is a schematic block circuit diagram of the electronic regulating device according to the invention.

In block-diagram form, FIG. 1 illustrates the electronic regulating device for the rpm of an internal combustion engine having self-ignition, using the example of a Diesel engine. An accelerator pedal 10 actuates an angle-to-voltage converter 11. This converter 11 is followed by a series circuit comprising the comparison point 12, the maximum-value selection circuit 13, the comparison point 14, and the regulator 15. The regulator 15 is followed in turn on the output side by an adjusting member 16 for the regulating rod (not shown) of the internal combustion engine 17. The output signal of the regulator 15 is switched, via a feedback circuit 18 such as shown by the function generator 52 (one dimensional) in U.S. Pat. No. 4,223,654, to the negative input of the comparison point 12. An idling rpm set-point transducer 20 furnishes the second input signal to the maximum-value selection circuit 13 such as shown at 59 in U.S. Pat. No. 4,223,654. An rpm signal from an rpm transducer 21 represents the signal at the negative input of the comparison point 14.

Reference numerals 23 and 24 each indicate a performance-graph generator such as shown at 52 (two dimensional) in U.S. Pat. No. 4,223,654, which are linked on the input side with the rpm transducer 21 and converter 11. On the output side, each performance-graph generator 23 and 24 is connected with one comparison circuit 25 and 26. The two comparison circuits 25 and 26 receive their second input signal from the output of the regulator 15. Its control input 27 may be connected via switches 28 and 29 with the outputs of the performance-graph generators 23 and 24, and the switches 28 and 29 are controlled by the output signals of the comparison circuits 25 and 26.

The mode of operation of the regulating device shown in FIG. 1 has long been familiar in principle. A particular accelerator-pedal position corresponds to a specific rpm set-point value at the output of the converter 11. The quantity desired by the regulator 15, which is expressed at the regulator 15 output, influences the rpm set-point value via the subsequent subtraction point 12 in such a way that for an increasing desired quantity, a decreasing rpm set-point value is established. This value is compared at 13 with the value for the idling rpm. Thus, as the rpm set value decreases for an increase in desired fuel quantity, the rpm set value is limited (on its low end) by circuit 13 to the predetermined rpm set point value for idling. A comparison point for the actual rpm follows, and the subsequent regulator 15 forms an output signal in accordance with the instant deviation in rpm from the desired value. The output signal of the regulator 15 represents the desired fuel quantity QK, and the engine 17 is supplied with the corresponding fuel quantity via the final control element, adjusting member 16 and the regulating rod coupled therewith. With the portion of the subject of FIG. 1 which has just been described above, it is possible to produce essentially the performance graph shown in FIG. 2*a*. At the idling rpm nLL, a vertical line is produced during stationary operation, dictated by the fade-out of the feedback effected by the maximum-value selection circuit 13. The individual drops in characteristic curves can be shifted in accordance with the position of the driving pedal.

Figure 2:
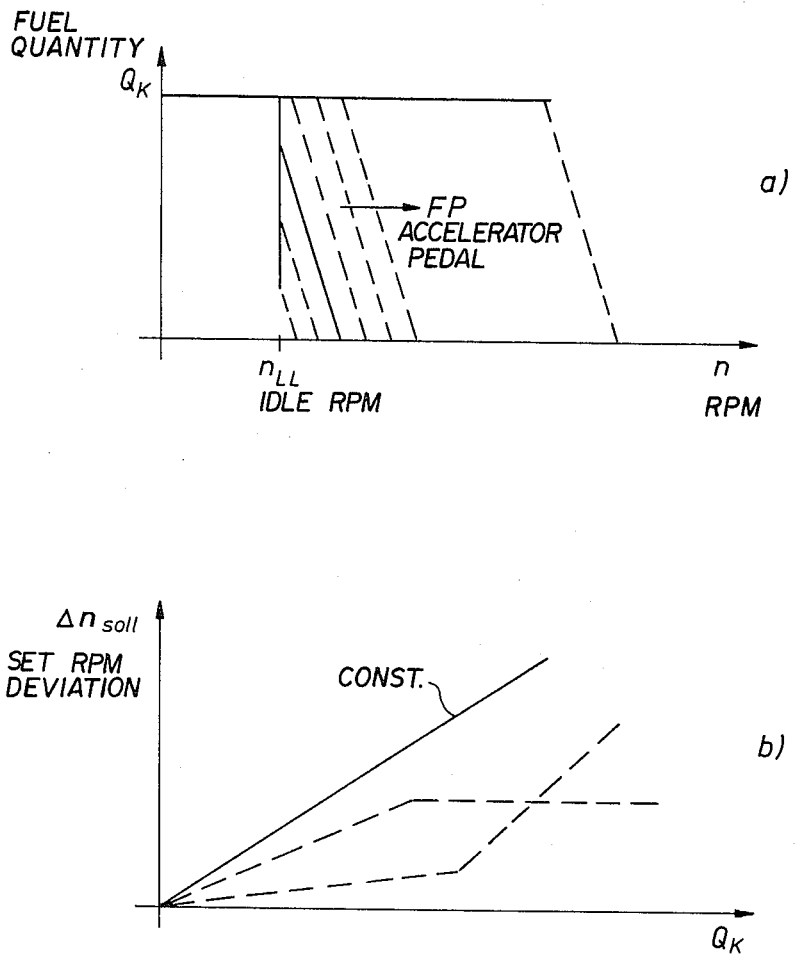
FIGS. 2*a* and *b* show characteristic curves for the purpose of comprehending both the regulatory function and the possible manner of embodying the feedback circuit.

FIG. 2*b* shows possible functional courses of the feedback circuit 18. The set-point rpm deviation is plotted over the desired fuel-quantity signal QK, and the unbroken straight line is the result in the case of a constant feedback rate. Two functional courses are also indicated by broken lines; these pertain to a nonlinearity in the feedback which may be desired in certain cases.

Figure 3A:
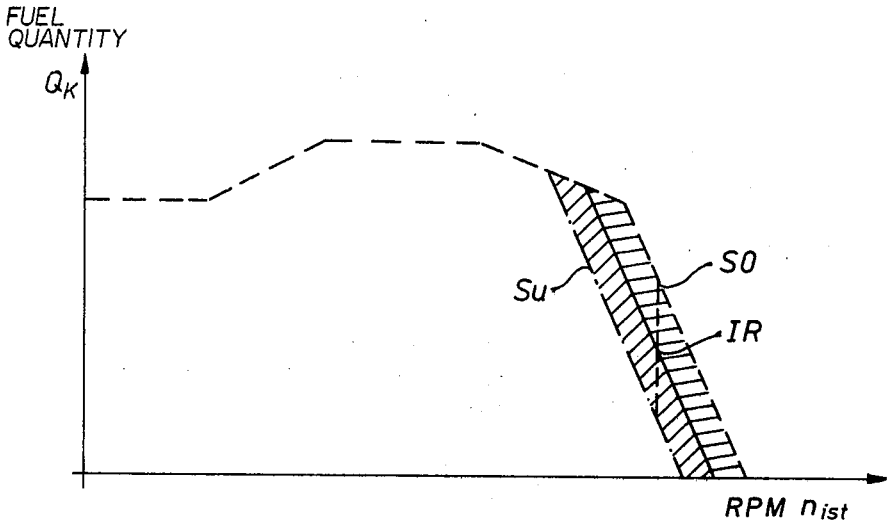
FIGS. 3*a* and 3*b*, in order to explain the threshold characteristic curves, shows these curves plotted in a regulator performance graph and explains the effect of a load drop.

FIG. 3*a* illustrates the control of the regulator 15 of FIG. 1 in terms of a manipulation of the regulator status, with the aid of a simplified performance graph. The dashed line IR represents a static or stationary shutoff curve—that is, one under steady state conditions. For instance, if there is a slow change in engine load, engine operation will follow line IR. An upper-limit characteristic curve is labelled SO and a lower-limit characteristic curve is labelled Su. With respect to the fast large signal behavior, these two limitation curves represent shutoff curves with purely proportional functioning.

What is of the essence is that there is no regulator manipulation as long as the deviation of either quantity or rpm remains within the range indicated by shading—that is, as long as it is between the two limitation curves. However, if the deviation is greater, then a control of the regulator is effected such that this deviation is restricted to one of the two limitations.

Figure 3B:
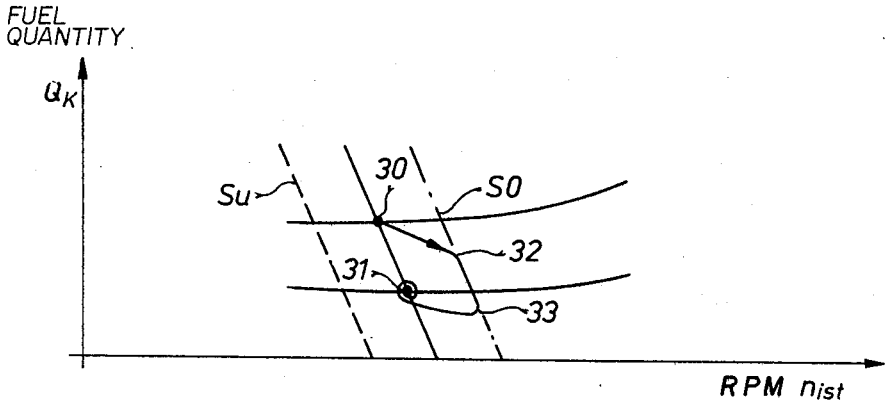

FIG. 3*b* illustrates the desired mode in the case of a load drop (fast decrease in engine load), with the outset point being indicated at 30. When there is an abrupt load change down to a load curve, which cuts point 31, the rpm increase, until reaching the upper limitation line SO at point 32 and running downward along this line, with the rpm still increasing. At 33, at a QK value below the lower load curve, the rpm again leave this upper limitation line and take a spiral course until they finally attain the target point.

The closer to the outset point this upper limitation line SO is located, the more rapidly the regulation adjustment takes place. In any case, there are limits to the possible approximation, which are set for reasons of stability and control behaviour, for instance. If both limitation lines coincide, the same unstable functioning is attained as in a P (proportional) regulator having a comparable steepness in its characteristic curve.

With a view to attaining optimal limitation lines, it proves to be suitable to make them dependent on instantaneous rpm and on the position of the accelerator pedal (set-point rpm).

The realization of the signal behavior shown in FIG. 3*b*, in combination with the limiting lines, is attained with the performance-graph generators 23 and 24, having the subsequent comparison circuits 25 and 26, shown in FIG. 1. Inscribed in the two performance-graph generators 23 and 24, shown in block form, are characteristic curves whose shutoff is effected at different rpm levels. The performance-graph generator 23 furnishes the upper limitation line SO, while the second performance-graph generator 24 furnishes the lower limitation line Su. If the output value of the regulator 15 exceeds one of the two output signal values of the performance-graph generators 23 and 24, then one of the two switches 28 and 29 is switched accordingly; as a result, the output of the appropriate performance-graph generator 23 or 24 is connected with the control input of the regulator 15. In this manner, the respective performance-graph value is fed directly into the regulator 15.

Figure 4:
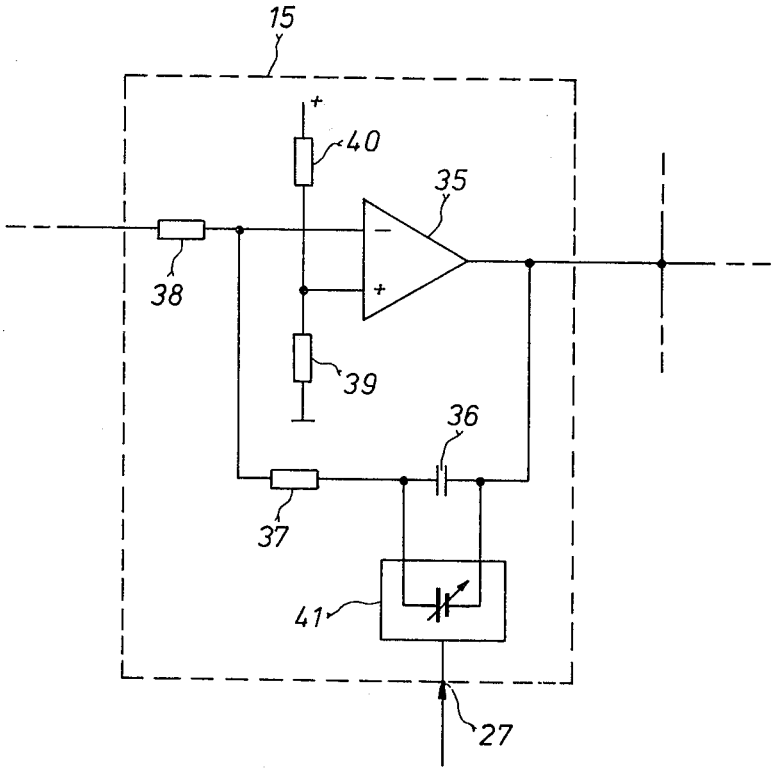
FIG. 4 shows one possible example of a controllable PI-regulator; and, finally.

One example of a controllable PI regulator 15 is shown in FIG. 4. Its primary component is a negative-feedback amplifier 35, with a series circuit comprising a capacitor 36 and a resistor 37 located in the negative-feedback branch. A further resistor 38 is disposed on the input side. Finally, the connecting point of a voltage divider comprising two resistors 39 and 40 is connected between the operating voltage supply lines, at the non-inverting input of the amplifier 35.

The charging of the capacitor 36 (the I component) of the regulator 15 can thereby be set or varied at discrete times, by briefly connecting the capacitor 36 to that potential, which is defined by the respective performance graph generator 23 or 24. This is effected via a voltage source 41 controllable via the input 27. This controllable voltage source 41, in contrast to a possible controllable current source, does not serve to vary the integration time constant; instead, within the briefest possible time (t approaches o), it defines the energy status of the PI regulator.

Thus, the performance graph generators 23, 24 via comparators 25, 26 control the voltage level of supply 41. This variable supply 41 sets the charge level of capacitor 36. Though the rate of discharge of capacitor 36 is unaffected by the biasing of voltage supply 41, the initial voltage level from which the capacitor discharges is determined by the voltage level of supply 41.

Figure 5:
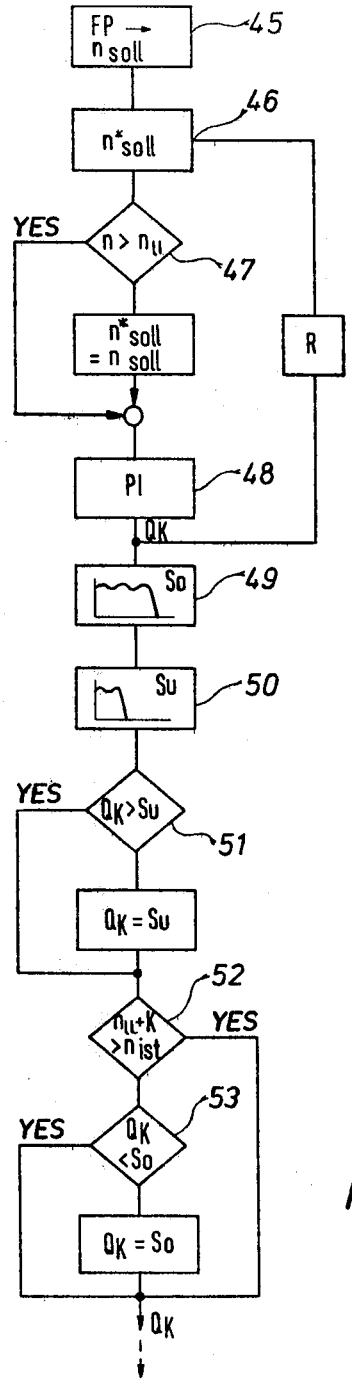
FIG. 5 is a flow diagram corresponding to the mode of operation of the subject of FIG. 1 this flow diagram may also be the basis for programming a regulator embodied in a process computer.

With a view to providing computer control even in Diesel engines, which is desirable for reasons of precision, the programming may be done relying on the flow diagram of FIG. 5 and can be implemented by an Intel 8051 microprocessor. According to this flow diagram, a set-point rpm value is ascertained in a first program element 45 on the basis of a specific accelerator-pedal position. In a subsequent program element 46, a feedback value from the regulator output signal is subtracted from this set-point rpm value. An interrogator circuit 47 follows, corresponding to the maximum-value selection circuit 13 of FIG. 1; this circuit limits an rpm set-point value which is growing smaller (as dictated by circuit 46) to the predetermined rpm set-point value for idling. The PI regulator 15 of FIG. 1 corresponds to a program block 48, in which the fuel quantity set-point value is ascertained in accordance with the following formula:

$$QK = Kp \cdot \Delta n + \frac{Ts}{Ti} \cdot \Sigma \Delta n$$

where Kp represents an arbitrary constant factor, Δn is the instantaneous rpm deviation; Ts is the scanning time, and Ti is the integration time constant.

Program elements 49 and 50 follow, intended for the purpose of respectively forming the upper and lower limitation curves SO and Su. An interrogator unit 51 for the lower threshold value follows, as does a further interrogator unit 52, for the purpose of shutting off the subsequent monitoring (comparison point 53) with the SO curve at idling rpm. Finally, further interrogator and limitation program elements may be added as well.

With the described electronic regulating device for regulating the rpm of an internal combustion engine having self-ignition, the realization of very steep characteristic curves can be attained while the regulation remains stable. For reasons of stability, the integration speed 1/TI (the speed of variation of the regulator status variable) can be selected to be very low. However, this means that in the event of a rapid variation in operating parameters, such as engine load in the case of load drop or load jump, the given quantity value which prevailed before the variation occurred would remain in force for a long time, until the regulator status has adapted to the new operational point. Thus, at least with a slow PI regulator, during a load drop the permissible rpm could be dangerously exceeded as the result of the fuel excess.

The most essential characteristic of the invention described above is that the regulator status or its output signal is controlled automatically by the upper and lower limitation line whenever a quantity signal exceeds the upper or lower limitation line. For this reason, a high regulating speed is attained, with simultaneously excellent stability, with the regulating device proposed herein.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An rpm regulating device in an electronic system for an internal combustion engine having an engine rpm sensor which generates an actual rpm signal, an engine idle rpm transducer which generates an idle rpm set point signal, and an accelerator pedal position sensor which generates a running rpm set point signal, and a selection and comparison means connected to receive said actual rpm signal, said idle rpm set point signal, and said running rpm set point signal to control engine operation via a fuel injection member in response thereto, said means including, a comparison means connected to receive and compare instantaneous values of said running rpm set point signal, said idle rpm set point signal and said actual rpm signal, and to generate an rpm difference signal in dependence thereon, and a PI regulator means connected to said comparison means for receiving said rpm difference signal, in order to generate a fuel quantity demand signal to said engine for controlling said fuel injection member.

2. A regulating device as defined in claim 1, having a means for generating threshold characteristic curves which determine the limits of a static droop characteristic.

3. A regulating device as defined in claim 2, wherein said means for generating characteristic curves is comprised of at least one performance graph generator.

4. A regulating device as defined in claim 3, wherein said PI regulator means includes an amplifier, a capacitor connected to said amplifier, and a variable voltage supply connected to said capacitor to control capacitor charging.

5. A regulating device as defined in claim 2, including an additional comparison means connected to receive and compare an output of said PI regulator means with the output of said droop characteristic generating means and having switching means to connect the signal of said droop characteristic generating means to said PI regulator.

6. A regulating device as defined in claim 1, wherein said PI regulator means comprises a feedback circuit, which generates a characteristic curve.

7. A regulating device as defined in claim 3, including an additional comparison means connected to receive and compare an output of said PI regulator means with the output of said means for generating characteristic curves, whereby said additional comparison means generates a signal as a function of said characteristic curves to determine the control input of said PI regulator means.

8. A method for regulating rpm in an electronic system for air internal combustion engines and controlling engine operation via a fuel injection member in response thereto comprising the steps of, generating an actual rpm signal, and an idle rpm set-point signal, establishing a running set-point rpm signal in response to accelerator pedal position, generating a difference signal in dependence on a comparison of said actual rpm, idle rpm set-point and running set-point signals, and, generating a fuel quantity demand signal in response to said rpm difference signal via said fuel injection member.

9. A method according to claim 8, wherein said fuel quantity demand signal QK satisfies the equation:

$$QK = Kp \cdot \Delta n + \frac{Ts}{Ti} \cdot \Sigma \Delta n$$

where Kp is a constant, Δn is the instantaneous rpm deviation, Ts is a scanning time, and Ti is an integration time constant.

10. A method according to claim 8, futher comprising the step of generating threshold characteristic curves for said fuel quantity demand signal.

11. A method according to claim 10, comprising the further step of determining upper and lower limits of a static droop characteristic of said characteristic curves.

* * * * *